US011397026B2

(12) United States Patent
Rodgers

(10) Patent No.: US 11,397,026 B2
(45) Date of Patent: Jul. 26, 2022

(54) BURNER FOR GAS-FIRED FURNACE

(71) Applicant: Ian Rodgers, Elgin, IL (US)

(72) Inventor: Ian Rodgers, Elgin, IL (US)

(73) Assignee: Robertshaw Controls Company, Itasca, IL (US)

( * ) Notice: Subject to any disclaimer, the term of this patent is extended or adjusted under 35 U.S.C. 154(b) by 268 days.

(21) Appl. No.: 16/666,783

(22) Filed: Oct. 29, 2019

(65) Prior Publication Data

US 2021/0123632 A1 Apr. 29, 2021

(51) Int. Cl.
*F24H 9/00* (2022.01)
*F24H 3/08* (2022.01)

(52) U.S. Cl.
CPC ..... *F24H 9/0068* (2013.01); *F24H 3/087* (2013.01); *F24H 2210/00* (2013.01)

(58) Field of Classification Search
CPC .... F24H 9/0052; F24H 9/0057; F24H 9/0063; F24H 9/0068; F24H 9/144; F24H 9/1818; F24H 9/1881; F24H 9/2085; F24H 3/006; F24H 3/025; F24H 3/087; F24H 2210/00; F28D 2021/0056; F23C 7/02; F23C 2700/04; F23C 2900/03009; F23N 2241/02; F24D 5/02; F24D 2200/0285; F23D 2203/1012; F23D 2206/0021; F23D 14/04; F23D 14/10; F23D 14/105; F23D 91/02
USPC ..... 431/12, 159, 346; 126/99 A, 99 R, 126/110 B, 110 C, 357.1
See application file for complete search history.

(56) References Cited

U.S. PATENT DOCUMENTS 1,424,739 A * 8/1922 Johnb ..... F23D 14/04 239/594
2,210,069 A * 8/1940 Ensign ..... F23D 14/586 239/552
2,563,683 A * 8/1951 Lewis ..... F23C 99/00 431/167
2,773,488 A * 12/1956 MacCracken ..... F24H 1/282 122/161
2,808,047 A * 10/1957 Jaye ..... F24H 3/105 126/116 R
3,375,792 A * 4/1968 Seeder ..... A21B 1/02 432/48
4,118,175 A * 10/1978 Riehl ..... F23D 14/105 431/354
4,476,850 A * 10/1984 Pickering ..... F24H 3/065 126/112
4,688,547 A 8/1987 Ballard et al.
(Continued)

FOREIGN PATENT DOCUMENTS

WO WO-2015062619 A1 * 5/2015 ..... F23C 3/002

*Primary Examiner* — Vivek K Shirsat
(74) *Attorney, Agent, or Firm* — Reinhart Boerner Van Deuren P.C.

(57) ABSTRACT

A burner system for gas-fired furnaces that includes a burner box having one or more burner heads. The burner box is linked to one or more heat exchanger tubes. A flame suppression tube extends from each of the one or more burner heads. The flame suppression tube extends in the direction of one of the one or more heat exchanger tubes. A space separates the flame suppression tube from the heat exchanger tube. A blower is configured to provide a mixture of flammable gas and air to the burner box. An air delivery means provides air in the space separating the flame suppression tube from the heat exchanger tube.

17 Claims, 4 Drawing Sheets

(56) References Cited

U.S. PATENT DOCUMENTS 4,878,480 A * 11/1989 Watson ..... F23C 3/002 126/91 A
4,938,283 A * 7/1990 Wood ..... F23C 5/00 126/104 R
5,257,616 A * 11/1993 Koziol ..... A47J 37/0704 126/41 R
5,375,586 A * 12/1994 Schumacher ..... F24H 8/006 126/11 OR
5,437,263 A * 8/1995 Ellingham ..... F24H 3/105 126/110 AA
5,562,440 A * 10/1996 Rodgers ..... F23D 14/08 431/328
5,649,529 A * 7/1997 Lu ..... F23M 9/06 431/352
6,478,577 B1 * 11/2002 Maricic ..... F23D 14/04 239/552
7,204,688 B2 * 4/2007 Han ..... F23D 14/64 431/347
8,025,048 B1 * 9/2011 Scarborough ..... F24C 3/14 126/38
8,206,147 B2 * 6/2012 Videto ..... F23D 23/00 431/12
8,591,222 B2 * 11/2013 Sherrow ..... F23N 5/022 431/353
2003/0213484 A1 * 11/2003 Alden ..... A47J 37/0713 126/41 R
2011/0311924 A1 * 12/2011 Proscia ..... F23M 20/005 431/114
2012/0178031 A1 * 7/2012 Roy ..... F23D 14/62 431/12
2012/0178032 A1 * 7/2012 Roy ..... F23D 14/26 431/178
2014/0020669 A1 * 1/2014 Sherrow ..... F24H 3/087 126/110 C
2014/0165991 A1 * 6/2014 Noman ..... F24H 9/0068 126/116 A
2015/0128926 A1 * 5/2015 Noman ..... F24H 9/1881 126/116 R
2015/0369495 A1 * 12/2015 Maricic ..... F23D 14/26 431/178
2016/0178236 A1 * 6/2016 Garloch ..... F23D 14/04 239/552
2020/0333043 A1 * 10/2020 Joyner, Jr. ..... F23M 20/005 431/114

* cited by examiner

BURNER FOR GAS-FIRED FURNACE

FIELD OF THE INVENTION

This invention generally relates to gas-fired hot air furnaces and, more particularly, to burners for such furnaces.

BACKGROUND OF THE INVENTION

Environmental concerns, such as climate change, have given rise to a number of new products designed to reduce the emission of pollutants such as greenhouse gases. Concurrently, there has been an increase in the number of regulations surrounding the emission of pollutants such as greenhouse gases.

For example, the state of California enacted South Coast Air Quality Management District (SCAQMD) Rule 1111, which has introduced maximum NOx (i.e., oxides of nitrogen) levels to be emitted by gas-fired appliances for several years. The maximum level has been gradually decreasing for several years. In 2015, the level of allowed NOx emissions for gas-fired furnaces was reduced to 14 nanograms per joule of useful heat (ng/juh) or approximately 20 parts per million (ppm) (depending on efficiency). Manufacturers have found this level difficult to achieve whilst also having a stable, quiet and efficient gas burner system. In many cases, manufactures are forced to pay a mitigation fee in order to sell into the California market, as a reliable solution to achieve this level has not been found.

Some conventional burner systems involve the use of in-shot burners often coupled with some mass in the flame to reduce the maximum temperature, and, therefore, the NOx level. This system can reduce NOx levels to below 40 ng/juh, but has been unsuccessful in meeting the lower standard of 14 ng/juh without large increases in carbon monoxide. Other conventional burner systems involve the use of premixed burners, which are widely used in other appliances and can achieve NOx levels of around 20 ng/juh. However, these appliances generally have a much larger combustion chamber area not suited to the furnace application. Still, another type of conventional burner system uses a staged partially premixed combustion system that allows a cost effective solution but cannot achieve the NOx levels desired.

Embodiments of the invention provide a burner system that improves upon the state of the art. These and other advantages of the invention, as well as additional inventive features, will be apparent from the description of the invention provided herein.

BRIEF SUMMARY OF THE INVENTION

In one aspect, embodiment of the invention provides a burner system for gas-fired furnaces that includes a burner box having one or more burner heads. The burner box is linked to one or more heat exchanger tubes. A flame suppression tube extends from each of the one or more burner heads. The flame suppression tube extends in the direction of one of the one or more heat exchanger tubes. A space separates the flame suppression tube from the heat exchanger tube. A blower is configured to provide a mixture of flammable gas and air to the burner box. An air delivery means provides air in the space separating the flame suppression tube from the heat exchanger tube.

In a particular embodiment of the invention, the air delivery means has an inducer motor configured to create negative pressure in the space separating the flame suppression tube from the heat exchanger tube. In certain embodiments, the burner head is made from a porous material, such as a ceramic material or metal fiber.

In a further embodiment, the flame suppression tube has one slot to facilitate cross ignition of a burner flame. A length of the slot, along a length of the flame suppression tube, may range from ¾ of an inch to one inch. The length of the slot extends from one end of the flame suppression tube towards the other end. In some embodiments, the other end of the flame suppression tube has a flange to facilitate attachment of the flame suppression tube to the burner box. A width of the slot may range from 0.4 inches to ¾ of an inch. The width of the slot extends along a circumference of the flame suppression tube.

In an alternative embodiment, the flame suppression tube has two slots to facilitate cross ignition of a burner flame. The flame suppression tube may be made from stainless steel or ceramic. A diameter of the flame suppression tube may range from 1.5 inches to 2.5 inches. A length of the flame suppression tube may range from 1.25 inch to 1.75 inches. In certain embodiments, the minimum distance between the flame suppression tube and the nearest heat exchanger tube ranges from 1.25 inches to 1.75 inches.

In a further embodiment or the invention, the flame suppression tube is a radiant tube. The flame suppression tube may be configured to operate at temperatures up to 2,000 degrees Fahrenheit.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Embodiments of the current invention use a fully premixed burner using excess air to cool the flame and reduce the peak temperature. The high port loading and increased burning velocity also combine to keep the time at peak temperature to a minimum, further reducing the formation of NOx. In the past, attempts to use premixed burners in the gas-fired furnaces have been unsuccessful, for several reasons, among them: high heat exchanger inlet temperatures; unacceptable noise levels; flame instability; high CO levels; and high NOx levels.

Figure 1:
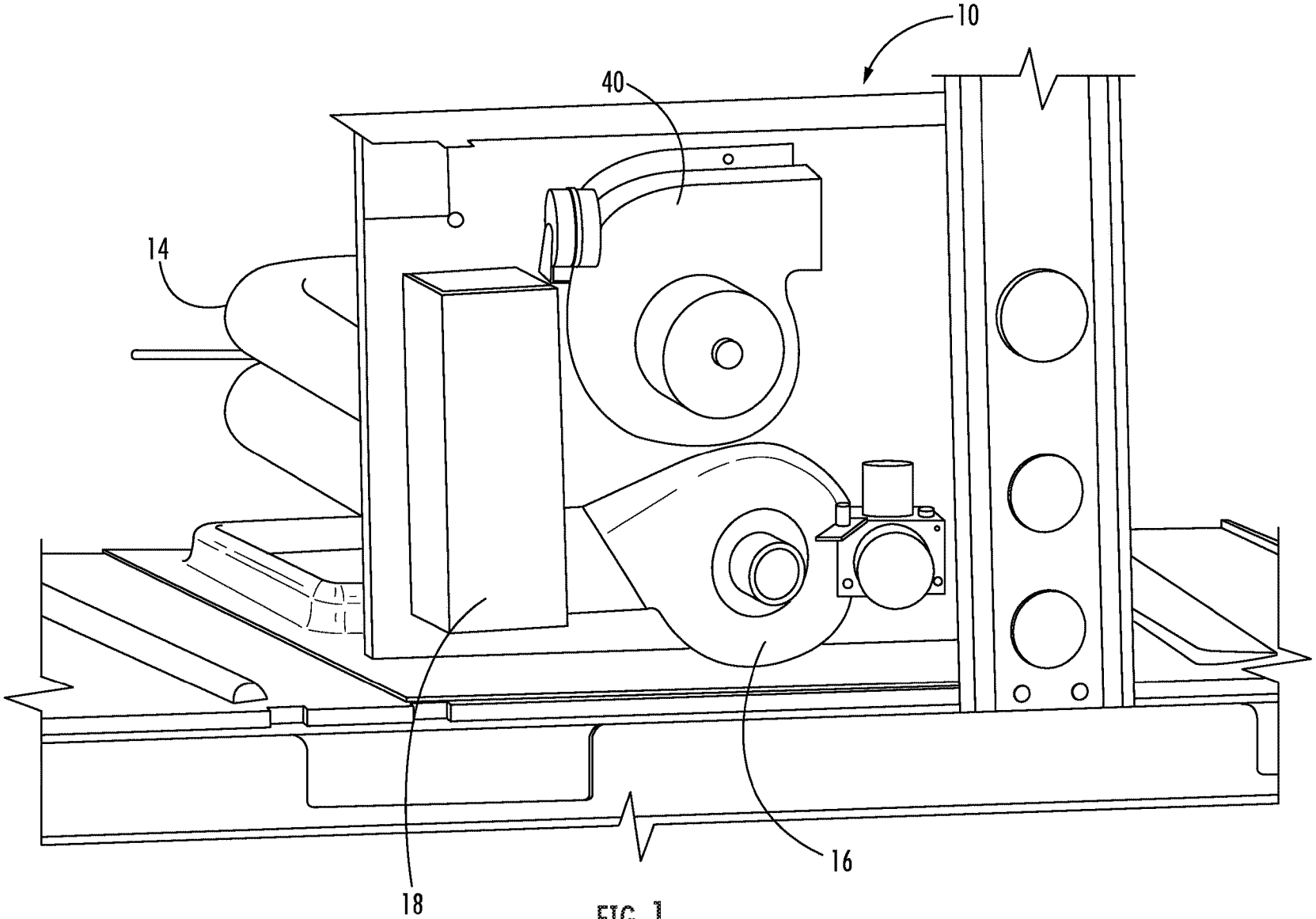
FIG. 1 is a perspective end view of a burner system for gas-fired furnaces, in accordance with an embodiment of the invention.
Figure 2:
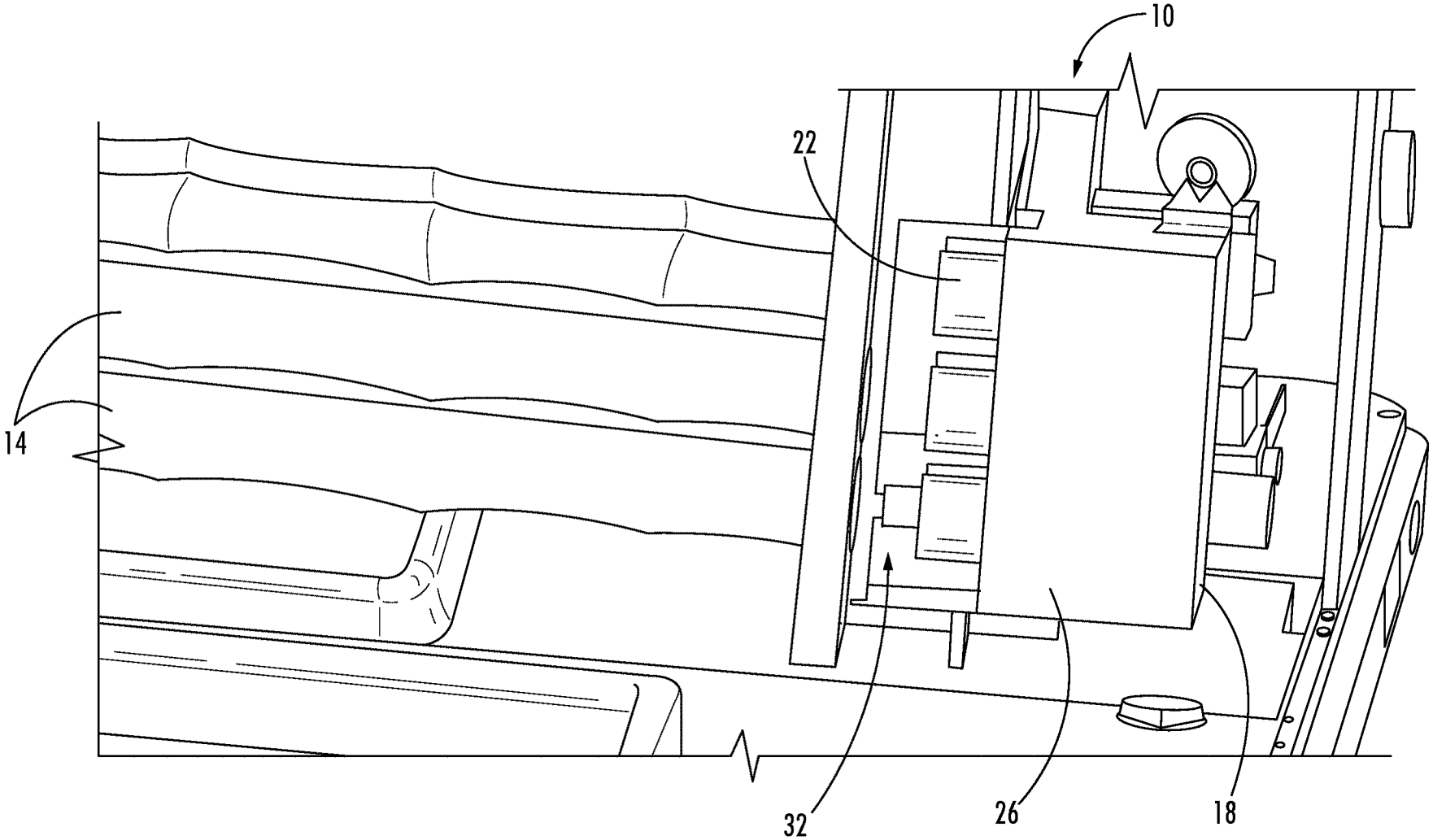
FIG. 2 is a perspective side view of the burner system for gas-fired furnaces, in accordance with an embodiment of the invention.
Figure 3:
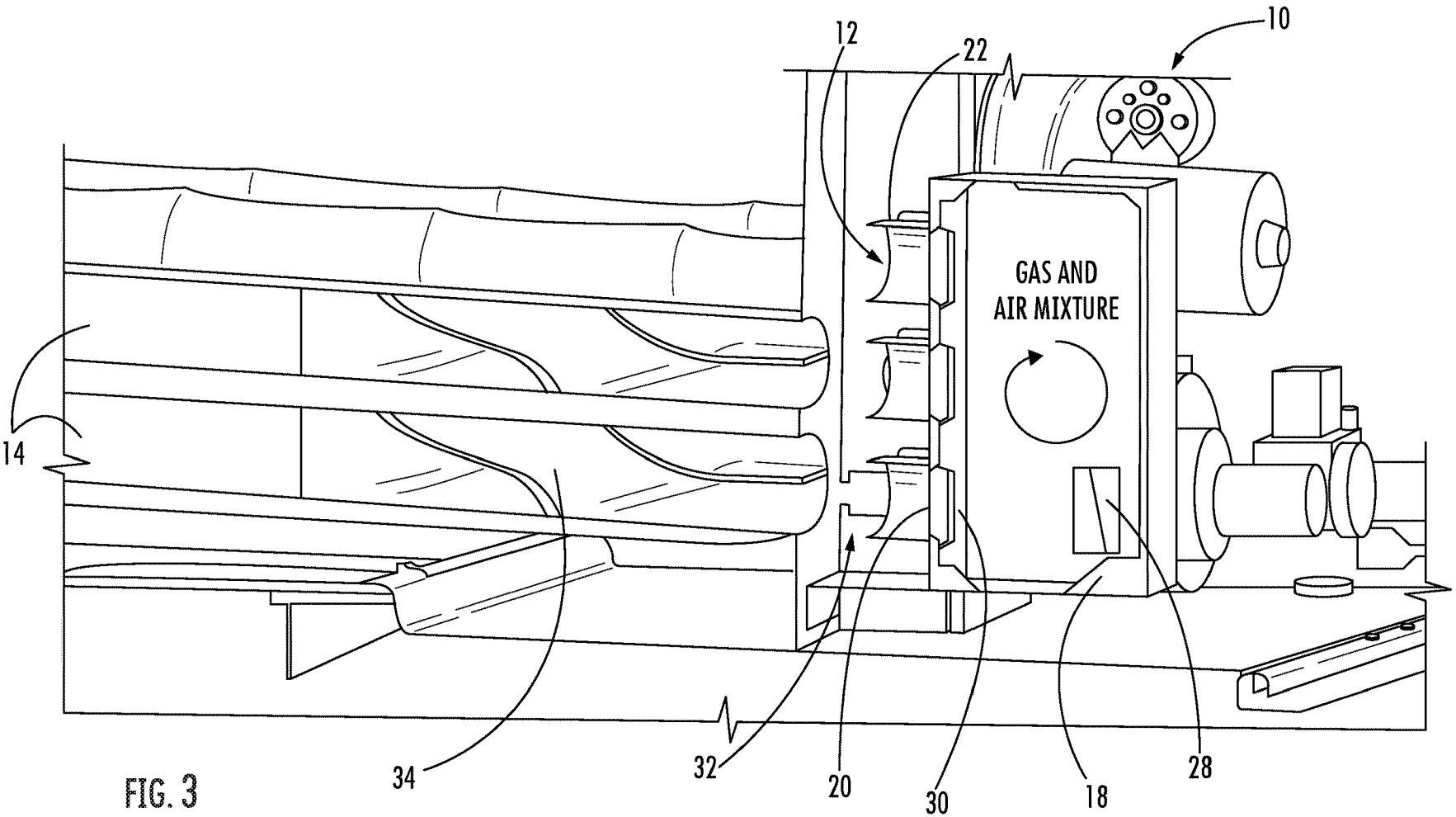
FIG. 3 is a perspective cross-sectional view of the burner system for gas-fired furnaces, in accordance with an embodiment of the invention.

Embodiments of the claimed invention, as illustrated in FIGS. 1-3, include a burner system 10 for a hot air furnace, with one or more burners 12, where the number burners 12 corresponds to the number of heat exchanger tubes 14 of the furnace heat exchanger. As shown in FIG. 3, a flammable gas and air are mixed in a venturi tube and blower system 16. The gas and air mixture is then fed into a burner box 18 and evenly distributed to one or more burner heads 20.

Though multiple embodiments of the burner box 18, having a variety of shapes and sizes, are envisioned, the burner box 18 shown in FIGS. 1-3 is a rectangular box with a removable cover plate 26. The burner box 18 has an inlet opening 28 through which the gas and air mixture flows into the burner box 18. On the side of the burner box 18 facing the heat exchanger tubes 14, there is at least one opening 30 in which the burner head 20 is installed.

In the embodiments shown, the burner box has three openings 30 for the burner heads 20. The openings 30 shown are round to accommodate cylindrical flame suppression tubes 22. However, in alternate embodiments, other shapes are envisioned for the openings 30. The burner heads 20 can be from various materials of a porous nature such as a ceramic or metal fiber. Flame suppression tubes 22 extend from each of the burner heads 20 to completely enclose and direct the flame.

The gas and air mixture is ignited with the use of a hot surface ignitor 24 or spark ignition. The flame is directed into the heat exchanger tubes 14 by the flame suppression tubes 22. As shown in FIG. 3, embodiments of the heat exchanger tube 14 include a baffle 34 disposed along the length of the heat exchanger tube 14. Secondary air is introduced to the system 10 downstream from the flame suppression tubes 22. As shown in FIGS. 2 and 3, there is a space 32 separating the heat exchanger tubes 14 from the flame suppression tubes 22. The secondary air is introduced into this space 32 via negative air pressure created in the space 32 by the system inducer motor 40. This secondary air keeps the furnace heat exchanger entrance plenum cool and allows for a decoupling of the burner system from the heat exchanger system.

Figure 4:
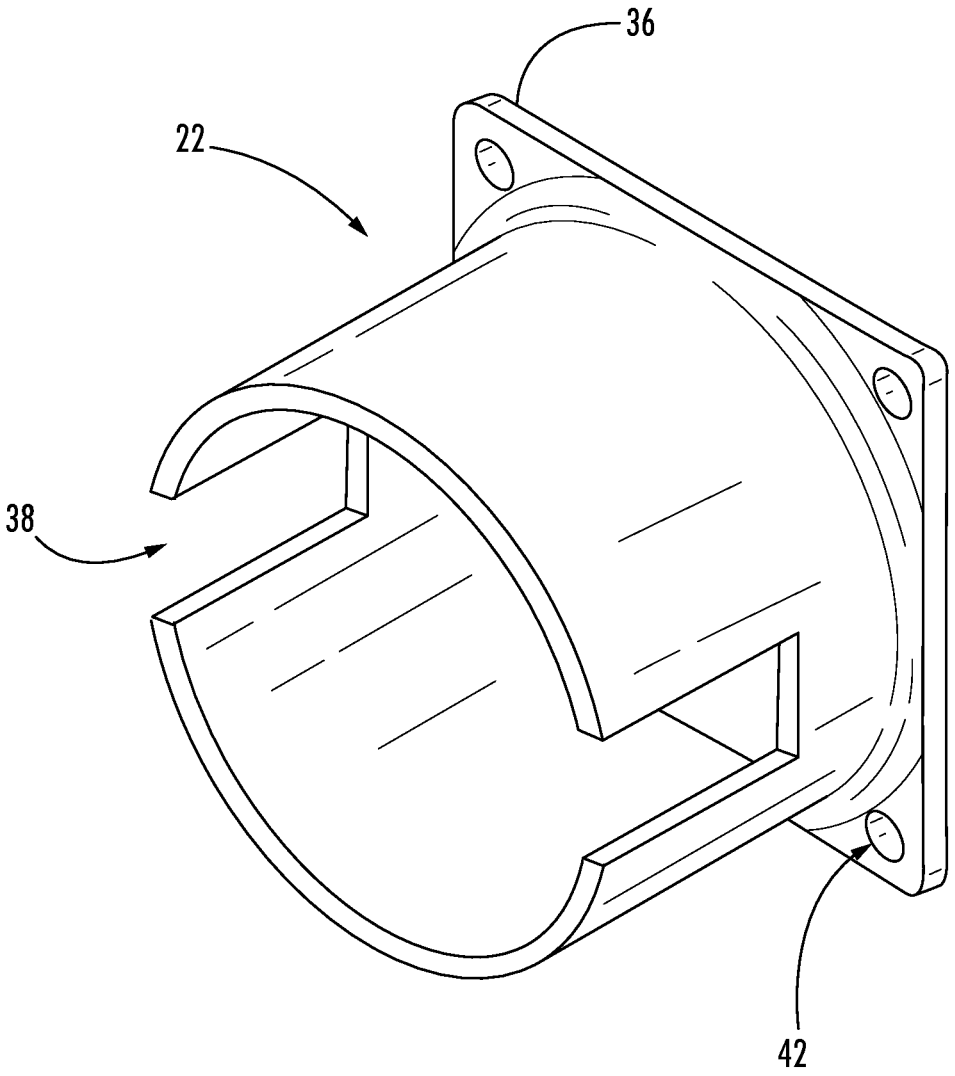
FIG. 4 is a perspective view of the flame suppression tube, constructed in accordance with an embodiment of the invention.

FIG. 4 shows a perspective view of the flame suppression tube 22, constructed in accordance with an embodiment of the invention. In the embodiment shown, the flame suppression tube 22 has a flange 36 at one end for attachment to the burner box 18. In the embodiment of FIG. 4, the flange 36 is rectangular with a hole 42 near each corner to accommodate a fastener, such as a screw or bolt, to facilitate attachment of the flame suppression tube 22 to the burner box 18. At the other end of the flame suppression tube 22, there are two slots 38 formed into opposite sides of this end. In alternate embodiments of the flame suppression tube 22, only one slot is formed in the end of the tube 22. In yet another embodiment no slots are incorporated. The presence of the slots 38 promotes cross-ignition between the various flame suppression tubes 22. In certain embodiments, the flame suppression tubes 22 have slots 38 in order to take further advantage of this transient pulse, and to allow smooth cross ignition at higher excess air levels, giving more security to the system.

In embodiments of the present invention, cross-ignition of the burner flame occurs even without the use of carry over ports or other ignition sources. This feature further helps to solve the problem of overheating the inlet plenum and tubes. Cross-ignition is the result of a transient pulse on initial ignition of the gas and air mixture. As a result, if only one flame suppression tube 22 is lit by the ignitor (spark or hot surface), the other flame suppression tubes 22 are ignited by the transient pulse of the adjacent tube's flame. It should also be noted that the transient pulse is short-lived, and therefore does not increase the temperature of the entrance of the heat exchanger tubes 14. This is facilitated by the short length of the flame suppression tube 22 and further by slots in the flame suppression tube 22.

In certain embodiments of the invention, the diameter of each of the flame suppression tubes 22 ranges from 1.5 inches to 2.5 inches, though larger and smaller diameters are envisioned. The typical length of the flame suppression tube 22 ranges from one inch to 1.5 inches though longer and shorter lengths are possible. The flame suppression tube 22 can be fabricated using steel, stainless steel, ceramics, or similarly suitable materials. The typical spacing between the flame suppression tubes 22 and the heat exchanger tubes is 2.75 to 3.0 inches though shorter and longer distances are envisioned.

Disclosed herein is a burner system 10 for gas-fired furnaces which is capable of operating while emitting lower levels of NOx gases than conventional burner systems. The reduced NOx levels are achieved by a combination of excess air, high port loading and increase flame speed. In some embodiments, high port loading and increased flame speed is facilitated by the radiant flame suppression tubes 22 which also increase burner stability and hence reduce carbon monoxide. Typical pre-mixed burners have port loadings in the range 100-4,000 Btu/in.$^2$ (surface area). However, the burner system 10 of the present invention operates at above 10,000 Btu/in.$^2$, yet with relatively low pressure drop—e.g., less than 2.0 inches water column. With respect to flame speed, the faster the burning velocity (flame speed) the more stable the flame tends to be.

Also disclosed herein is a burner system 10 for gas-fired furnaces which is capable of operating while emitting lower levels of NOx gases than conventional burner systems. The reduced NOx levels are achieved by a combination of excess air, high port loading and increase flame speed. In some embodiments, high port loading and increase flame speed is facilitated by the radiant flame suppression tubes 22 which also increase burner stability and hence reduce carbon monoxide.

Broadly speaking, radiant flame suppression tubes 22 transfer heat to a load. Heat exchange occurs when the combustion fumes are generated by the burner and then conveyed through the radiant flame suppression tubes 22 to the furnace heat exchanger. Various sizes and shapes of different heat resistant materials are used for these tubes depending on the specific need, service temperature, and furnace atmosphere. Regardless of their shape or size, radiant flame suppression tubes 22 are used to ensure that no contact between the flames from the burner and any material in the furnace occurs. Radiant tubes are also used because they are able to reach process temperatures up to 2,000° F. (1,100° C.) and maintain temperature uniformity.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A burner system for gas-fired furnaces comprising:

a burner box having one or more burner heads where ignition of a fuel takes place, the burner box being linked to one or more heat exchanger tubes;

a flame suppression tube extending from each of the one or more burner heads, the flame suppression tube extending in the direction of one of the one or more heat exchanger tubes, a space separating the flame suppression tube from the heat exchanger tube;

a blower configured to provide a mixture of flammable gas and air to the burner box; and an air delivery means to provide air in the space separating the flame suppression tube from the heat exchanger tube.

2. The burner system of claim 1, wherein the air delivery means comprises an inducer motor configured to create negative pressure in the space separating the flame suppression tube from the heat exchanger tube.

3. The burner system of claim 1, wherein the burner head is made from a porous material.

4. The burner system of claim 3, wherein the burner head is made from a ceramic material or from metal fiber.

5. The burner system of claim 1, wherein the flame suppression tube has one slot to facilitate cross ignition of a burner flame.

6. The burner system of claim 5, wherein a length of the slot, along a length of the flame suppression tube, ranges from ¾ of an inch to one inch.

7. The burner system of claim 6, wherein the length of the slot extends from one end of the flame suppression tube towards the other end.

8. The burner system of claim 7, wherein the other end of the flame suppression tube has a flange to facilitate attachment of the flame suppression tube to the burner box.

9. The burner system of claim 5, wherein a width of the slot ranges from 0.4 inches to ¾ of an inch.

10. The burner system of claim 9, wherein the width of the slot extends along a circumference of the flame suppression tube.

11. The burner system of claim 1, wherein the flame suppression tube has two slots to facilitate cross ignition of a burner flame.

12. The burner system of claim 1, wherein the flame suppression tube is made from stainless steel or ceramic.

13. The burner system of claim 1, wherein a diameter of the flame suppression tube ranges from 1.5 inches to 2.5 inches.

14. The burner system of claim 1, wherein a length of the flame suppression tube ranges from 1.25 inch to 1.75 inches.

15. The burner system of claim 1, wherein a minimum distance between the flame suppression tube and the nearest heat exchanger tube ranges from 2.75 inch to 3.0 inches.

16. The burner system of claim 1, wherein the flame suppression tube is a radiant tube.

17. The burner system of claim 16, wherein the flame suppression tube is configured to operate at temperatures up to 2,000 degrees Fahrenheit.

* * * * *